US006964342B2

(12) United States Patent
Wenzler

(10) Patent No.: US 6,964,342 B2
(45) Date of Patent: Nov. 15, 2005

(54) HANGING DEVICE

(76) Inventor: Michael James Wenzler, 1025 W. Rahn, Dayton, OH (US) 45429

( * ) Notice: Subject to any disclaimer, the term of this patent is extended or adjusted under 35 U.S.C. 154(b) by 0 days.

(21) Appl. No.: 10/758,556

(22) Filed: Jan. 15, 2004

(65) Prior Publication Data

US 2005/0155946 A1 Jul. 21, 2005

(51) Int. Cl.[7] ..... A47F 2/18; B42F 1/00

(52) U.S. Cl. ..... 211/45; 211/113; 211/124; 211/52

(58) Field of Search ..... 211/45, 113, 86.01, 211/96, 89.01, 124, 49.1, 52, 55; 223/90, 223/91, 93, 96; 206/278–300, 8, 9, 11; 40/652; 248/316.1–316.3, 316.5, 316.7

(56) References Cited

U.S. PATENT DOCUMENTS

| | | | | | |
|---|---|---|---|---|---|
| 639,875 | A | | 12/1899 | Wagner | |
| 1,081,848 | A | | 12/1913 | Macdonald | |
| 1,634,532 | A | | 7/1927 | Bowe | |
| 2,261,005 | A | | 10/1941 | Thompson et al. | |
| 2,496,531 | A | | 2/1950 | Gray | |
| 2,524,537 | A | | 10/1950 | Osmonson | |
| 2,527,484 | A | | 10/1950 | Lester | |
| 2,779,114 | A | * | 1/1957 | Orthwine | 40/658 |
| 2,987,193 | A | | 6/1961 | Pajor | |
| 3,123,331 | A | | 3/1964 | Field et al. | |
| 3,214,810 | A | | 11/1965 | Mathison | |
| 3,235,928 | A | | 2/1966 | Clark | |
| D204,134 | S | | 3/1966 | Duncan | |
| 3,624,873 | A | * | 12/1971 | Frey | 24/555 |
| 3,698,607 | A | | 10/1972 | Batts | |
| 3,767,092 | A | | 10/1973 | Garrison et al. | |
| 3,946,915 | A | | 3/1976 | Crane | |
| 3,953,065 | A | * | 4/1976 | Shannon, Jr. | 294/1.1 |
| 3,982,307 | A | | 9/1976 | Smith et al. | |
| 4,010,517 | A | * | 3/1977 | Kapstad | 24/67.11 |
| 4,023,721 | A | | 5/1977 | Erthein | |
| 4,194,635 | A | * | 3/1980 | Ferrara | 211/45 |
| 4,723,665 | A | | 2/1988 | Benedict et al. | |
| 4,763,390 | A | | 8/1988 | Rooz | |
| 4,830,322 | A | * | 5/1989 | Gary | 248/206.5 |
| 4,899,974 | A | * | 2/1990 | Wear et al. | 248/467 |
| 5,318,174 | A | * | 6/1994 | Zoroufy | 211/45 |
| 5,535,896 | A | | 7/1996 | Morgan, Sr. | |
| 6,021,907 | A | * | 2/2000 | O'Brien | 211/89.01 |
| 6,021,933 | A | | 2/2000 | Zuckerman | |
| 6,257,422 | B1 | * | 7/2001 | Rios | 211/45 |
| 6,481,585 | B1 | * | 11/2002 | Cloughton | 211/89.01 |
| 6,547,200 | B2 | * | 4/2003 | Dilworth | 248/316.5 |

* cited by examiner

*Primary Examiner*—Jennifer E. Novosad
(74) *Attorney, Agent, or Firm*—R. William Graham

(57) ABSTRACT

A hanging device having a base that is to be connected to a vertical support or wall, with its long axis of the base vertically disposed. A plurality of horizontally disposed retainers extend across a front face of the base, wherein each retainer includes a pair of retainer members which are biased toward one another. The members are configured to be movably displaced from one another to readily permit the insertion of an article to be hung, such as a garment, therebetween.

16 Claims, 7 Drawing Sheets

Fig. 3
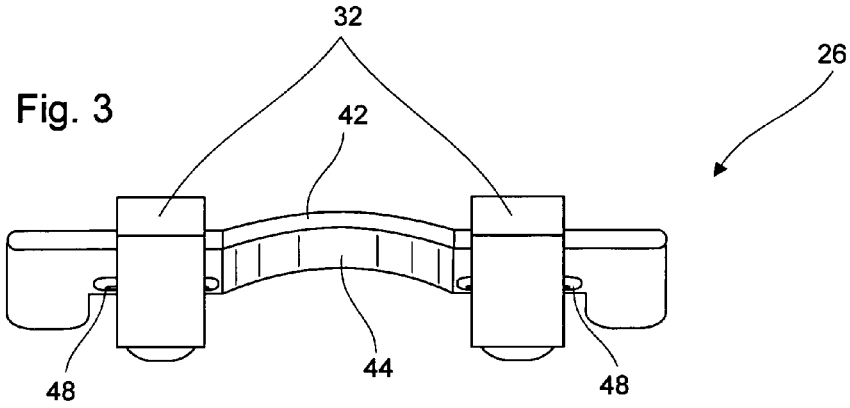
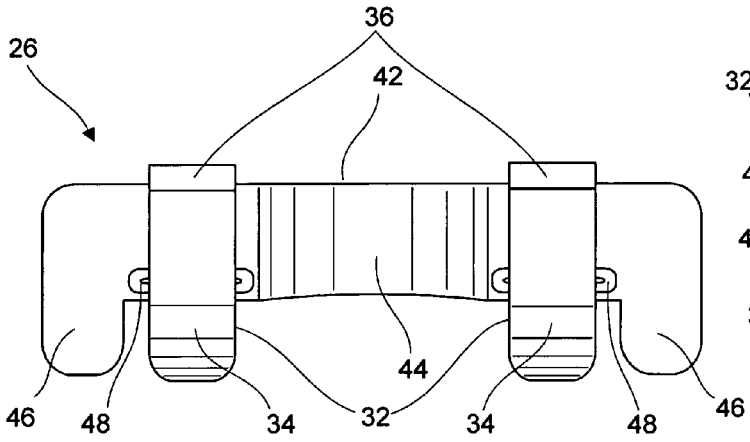
Fig. 4
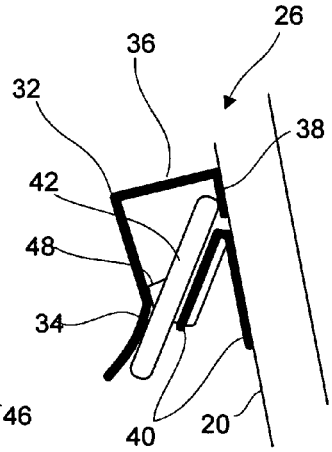
Fig. 5
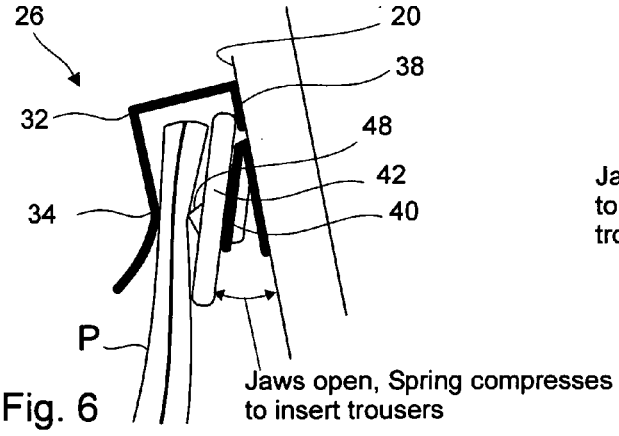
Fig. 6
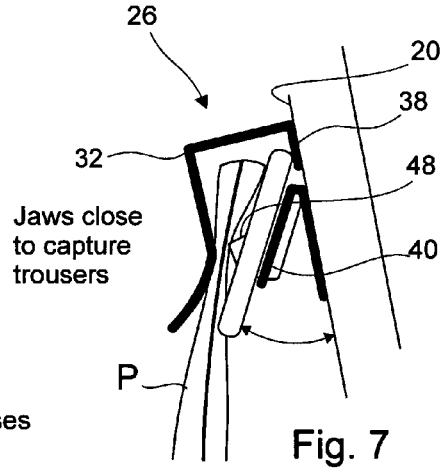
Fig. 7

HANGING DEVICE

BACKGROUND OF THE INVENTION

Field of the Invention

This invention is generally related to organizers and holders and more particularly to a device to hang a plurality of trousers or the like in a limited space.

Conventional hangers for trousers, skirts and the like ordinarily hold a single garment with a horizontal bar and a top hook for hooking over a closet rod. In many cases, the number of garments that need to be stored exceeds the space or hangers available. This has led to the development of several prior art devices which attempt to provide solutions in maximizing clothes storage.

Such organizers include telescoping supports or racks or pivoting racks which mount to a closet wall or an existing closet horizontal bar. Other prior racks and hanging devices pertinent hereto include a vertically extending post from which a plurality of vertically spaced horizontal support arms are pivotally connected enabling pairs of pants, skirts and other types of clothing to be suspended therefrom. When the clothes are hung on these arms, they are radially spaced and take on a helical pattern. Some of these include telescoping brackets for anchoring the organizers to the wall of a closet.

While there have been some advances in maximizing closet storage, there remains a need to provide an improved clothes hanging device which conserves more closet space, is simpler to use and reliably retains garments in a non-wrinkling manner.

BRIEF SUMMARY OF THE INVENTION

It is accordingly an object of the invention to provide a device for hanging clothes.

It is another object to maximize closet space.

It is still another object to provide the ability to hang a plurality of garments (trousers and the like) in a limited space without the trousers or the like being wrinkled.

It is another object that access to any one of the selected garments without the need to move the hangers for the remainder of the plurality.

The device of the invention includes an elongated base that is to be connected to a vertical support or wall, with its long axis of the base vertically disposed. A plurality of horizontally disposed retainers extend across a front face of the base, wherein each retainer includes a pair of retainer members which are biased toward one another. The members are configured to be movably displaced from one another to readily permit the insertion of an article to be hung, such as a garment, therebetween.

When the base is connected to the wall, the front face is preferably configured to be set at an angle with an upper part of the base further displaced from the wall than a lower part of the base. For example, when pant bottoms are hung from the retainers, the uppermost hung pants hang highest and are most displaced from the wall. The retainers are arranged one atop the other and spaced apart from one another so that there is enough space to accommodate a pair of pants, for example, in a plane. By loading the garments as shown and described herein, the user may access any single item by pulling the pants downward simply releasing the tension of the bias between any selected pair of retaining members. The garment may then be removed without disturbing any of the others.

These and other objects, advantages and features of the invention will become more apparent when the detailed description is studied in conjunction with the drawings.

BRIEF DESCRIPTION OF THE DRAWINGS

FIG. 3 is a top view of a retainer shown in FIG. 4.

FIG. 4 is a front view of retainer in FIG. 3.

FIG. 5 is a side view of a retainer of the present invention.

FIG. 6 is a side view of the retainer of FIG. 5 in an open in-use mode.

FIG. 7 is a side view of the retainer of FIG. 5 in a closed in-use mode.

DETAILED DESCRIPTION OF THE INVENTION

Figure 1A:
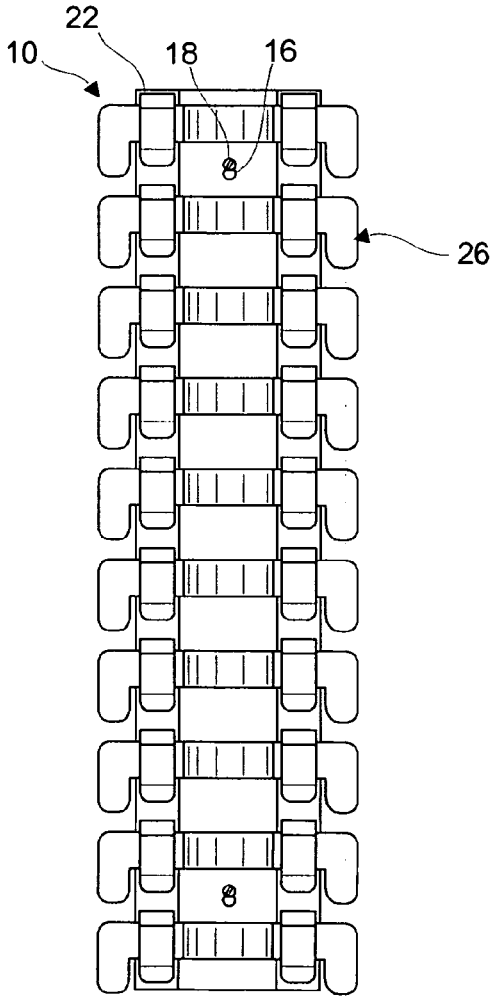
FIG. 1A is a front view of the present invention.
Figure 1C:
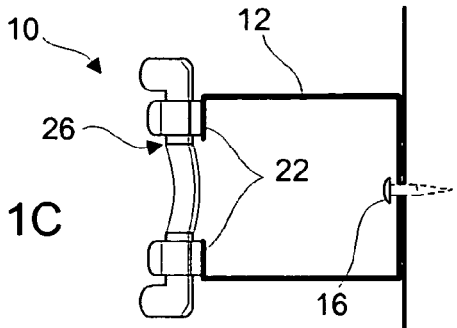
FIG. 1C is a top view of the embodiment in FIG. 1A.
Figure 2A:
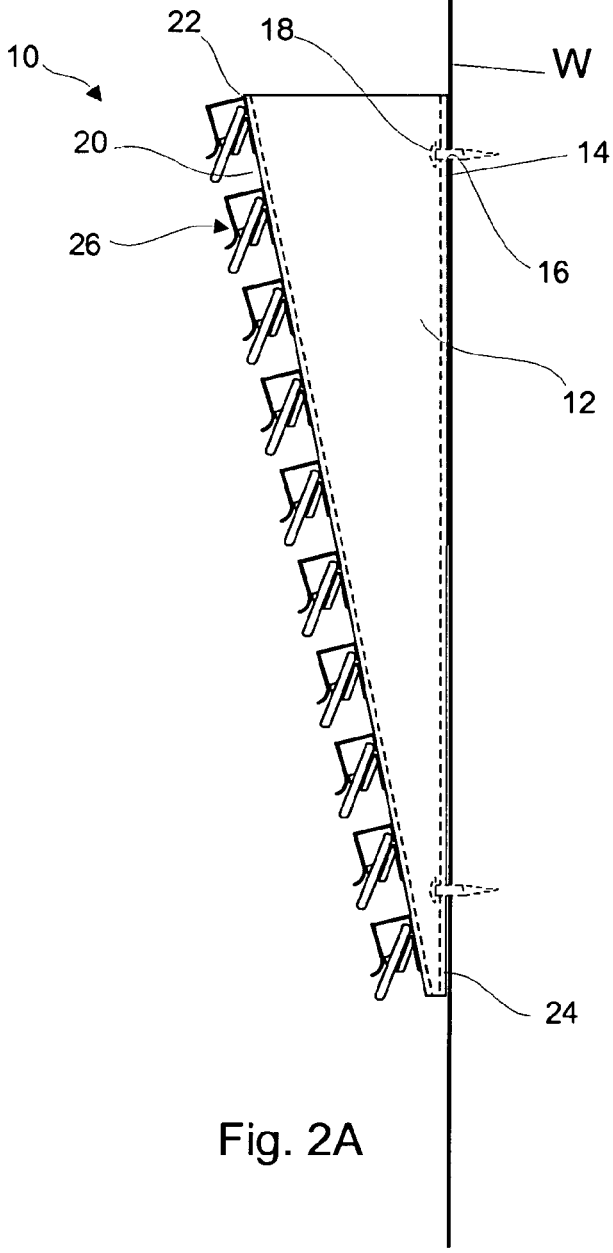
FIG. 2A is a side view of an embodiment of the present invention.

Referring now to the present invention, the clothing hanging device is generally designated by the numerals 10 and 10'. The clothing hanging device 10 includes a base 12 which is elongated having a back side 14 which can preferably be configured with apertures 16. Fasteners 18, such as screws, can be inserted through the apertures 16 to connect the base 12 to the wall W such that the back side 14 is generally coplanar with respect to the wall W.

A front side 20 of the base 12 can preferably be set at a predetermined angle with respect to the wall W. In this regard, an upper end 22 of the front side 20 is more outwardly disposed from wall W than a lower end 24.

Figure 1B:
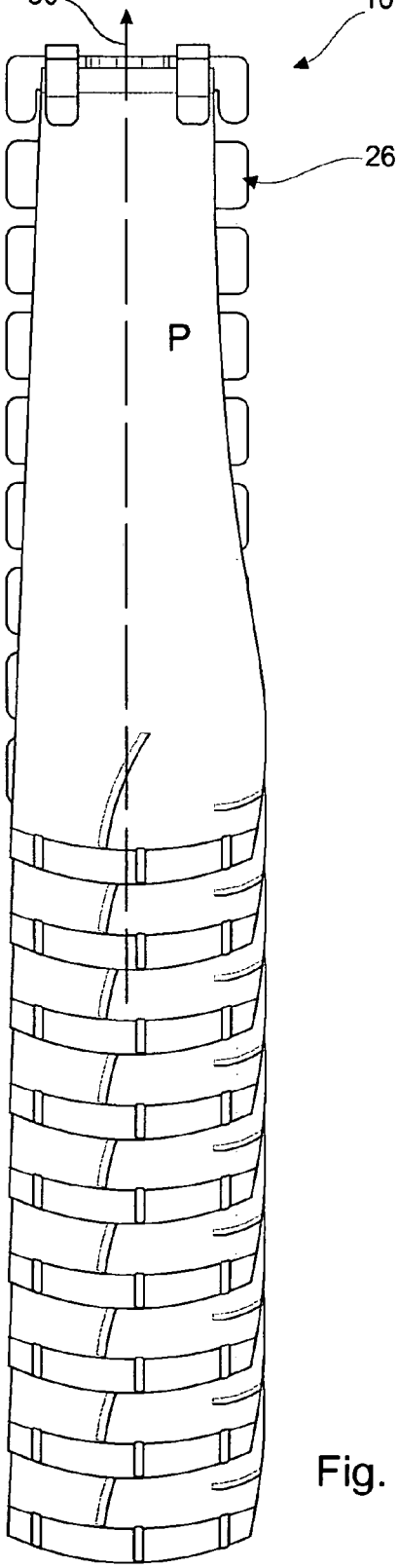
FIG. 1B is a front view of the present invention shown in use.
Figure 2B:
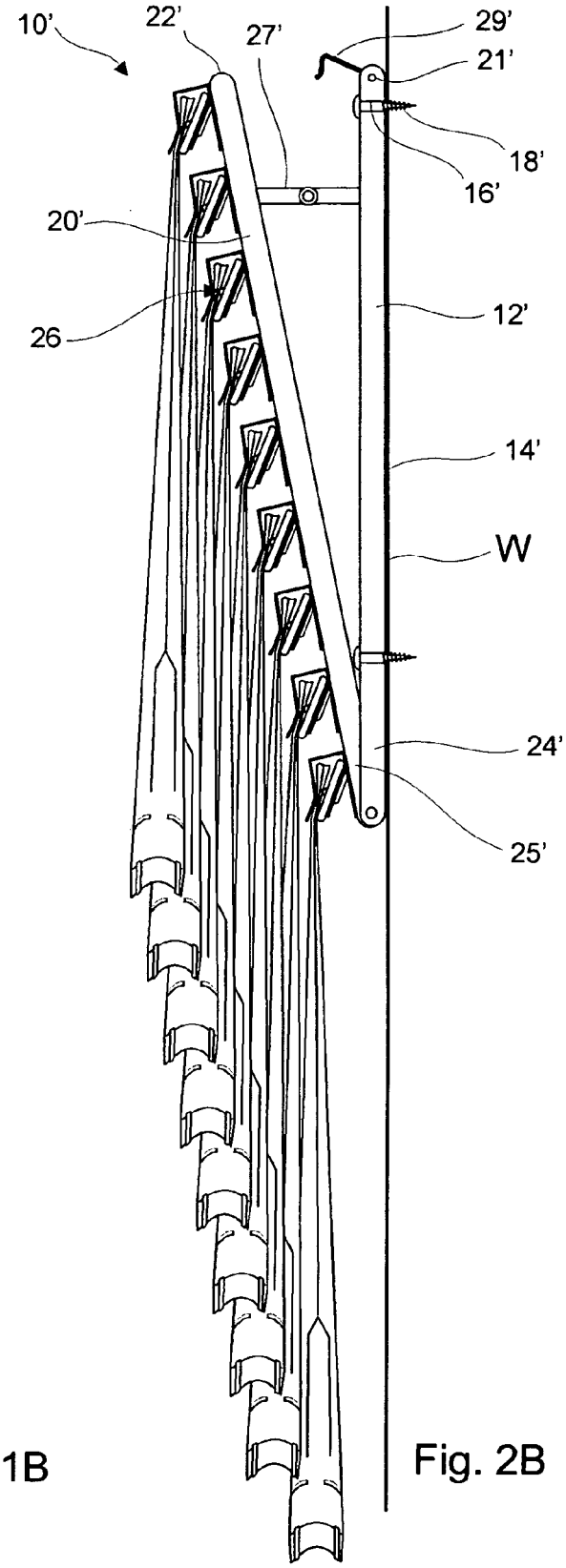
FIG. 2B is a side view of another embodiment of the present invention shown in use.

The front side 20 includes a plurality of retainers 26 which are generally horizontally disposed with respect to a longitudinal axis 30 of the base 12. The retainers 26 releasably retain pants P, for example. It is contemplated that the retainers 26 can retain other types of garments. As seen in FIGS. 1B and 2B, the pants P are spaced from one another in a manner to permit easy access for insertion and removal of thereof without the need to move adjacent hung pants P. Proximate the retention point, each pair generally lies in a plane.

Retainer 26 and its components are illustrated in FIGS. 3–7. The retainer 26 can include a generally U- or V-shaped retaining member 32 (i.e., a first retaining member) having an outwardly flared side 34 connected to a transverse portion 36 which in turn connects to a side 38. The side 38 mounts to the front side 20 by way of a fastener or other connecting means, for example. A biasing element 40, such as spring metal, is operably disposed adjacent the side 34 in a manner to bias toward the same.

A retaining plate 42 (i.e., a second retaining member) can preferably be generally U- or V-shaped, although not necessary, having a transverse central portion 44 and side portions 46 (i.e., first means for permitting). By way of example, there are shown two laterally spaced retaining members 32 in FIG. 4, with the retaining plate 42 disposed therebetween. Also, provided are ridged surfaces 48 extending from the plate 42 which are laterally spaced to generally align with an extend toward the sides 34 of the retaining members 32. The plate 42 is connected to biasing element 40 such that the plate 42 is normally biased into contact with the side 34 of the retaining member 32 as seen in FIG. 5.

Figure 15:
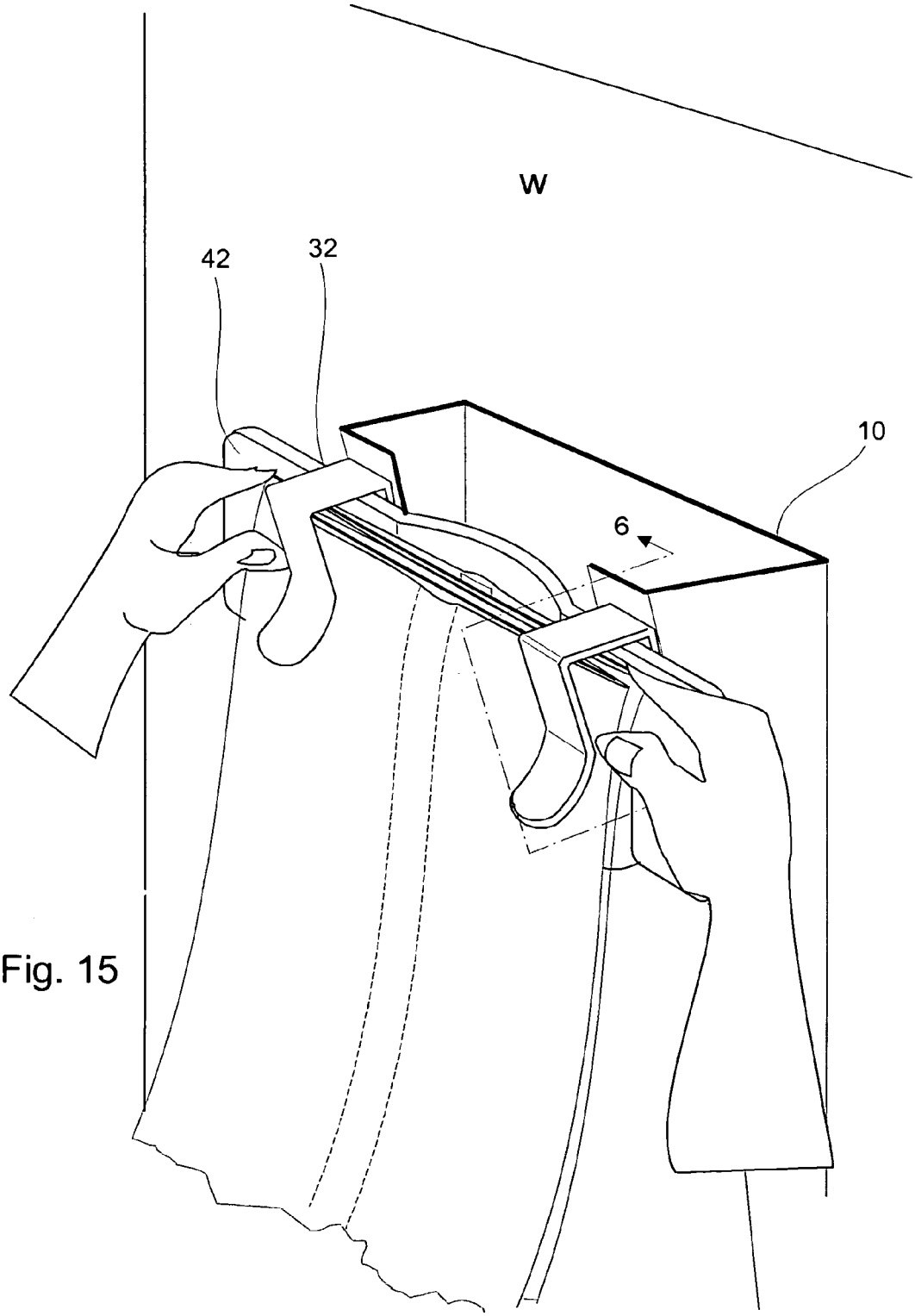
FIG. 15 is a perspective view illustrating the use of the invention.

To insert a garment, such as pants P, one's knuckles can be used to depress the plate 42 as seen in FIG. 15 to permit insertion of the pants P and permit removal by simply pulling down pants P. Once inserted, the biasing element 40 biases the plate 42 with ridged surface 48 against the pants P and into the side 34 as seen in FIG. 6. The pants P are retained through the spring force of the biasing element 40 as shown in FIG. 7. The ridged surface 48 can be smooth to aid in retention of garment, yet permit the release of the garment upon sufficient pulling force being applied thereto.

FIG. 2B illustrates another embodiment of the base 12'. Here, the base 12' includes a back side 14' hingedly connected to a front side 20' at respective lower ends 24' and 25' with a hinge 27' connecting respective upper ends 21' and 22'. In this embodiment, the front side 20' can be extended from the wall W to permit easy access to the retained garments, or collapsed against the side 14' and retained by a latch mechanism 29' to conserve further space in a closet.

Figure 1D:
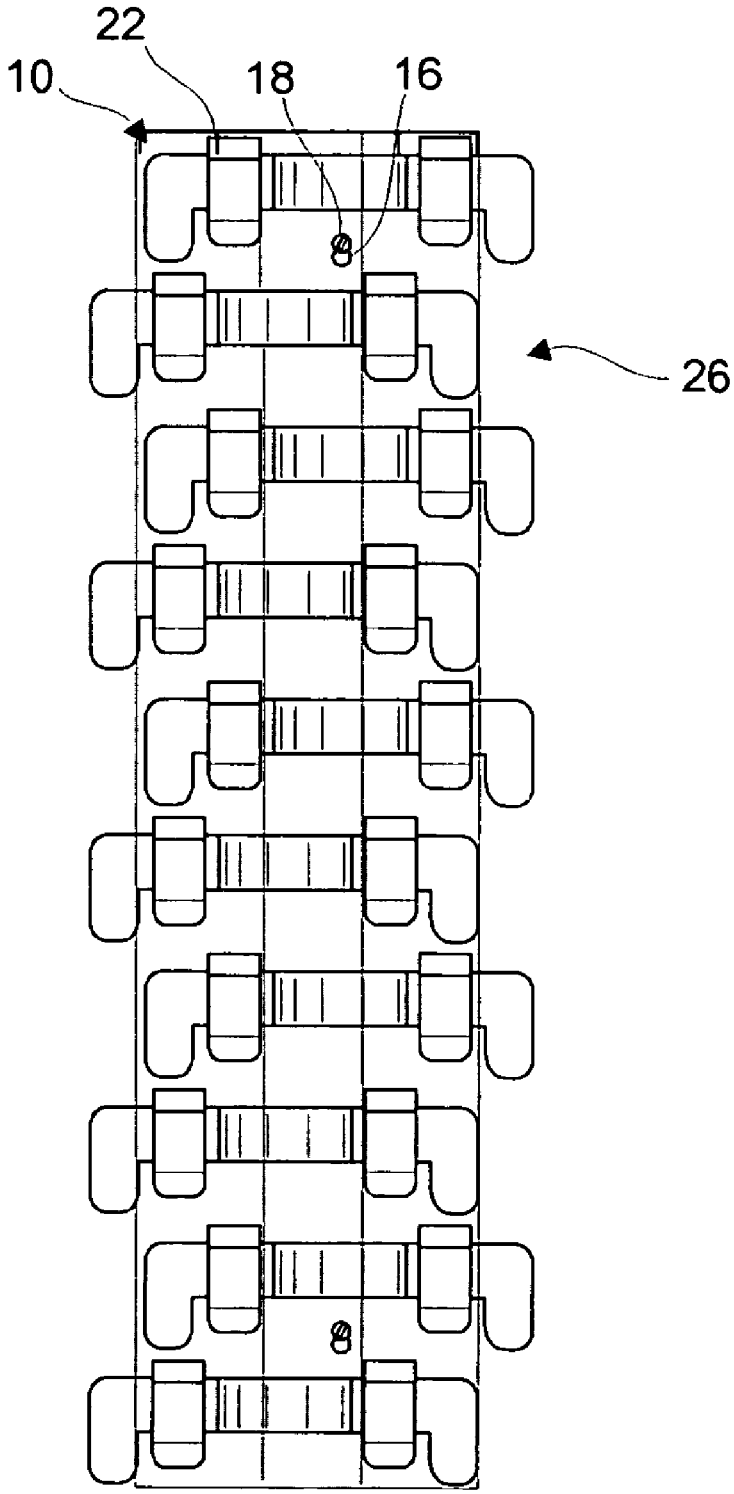
FIG. 1D shows a staggered version of the retainers used in the invention.

FIG. 1D shows the retainers 26 staggered in relation. In this way, at least a side portion of the articles, such as pants P, can be viewed to aid in their selection without having to move the other hung articles.

As illustrated in FIG. 3, the retaining member 26 has an arcuate central portion 44. This design can permit garments with thicker material and seamed areas to be more easily inserted adjacent the central portion 44.

Figure 8:
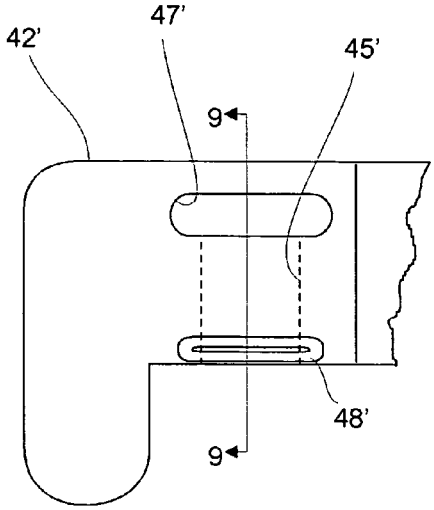
FIG. 8 is a partial view of part of the retainer in FIG. 4.
Figure 9:
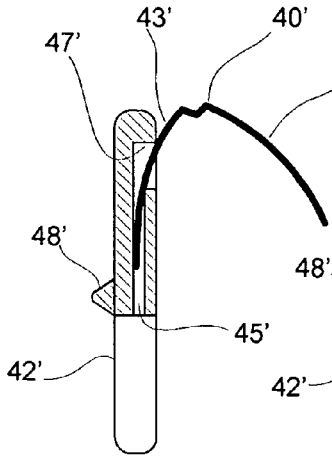
FIG. 9 is a cross-sectional view through line 9—9 in FIG. 8 with a biasing member partially inserted.
Figure 10:
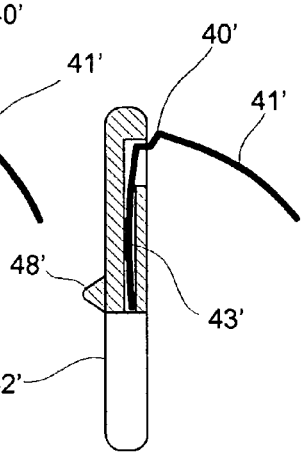
FIG. 10 is another cross-sectional view of FIG. 9 with a biasing member inserted.
Figure 11A:
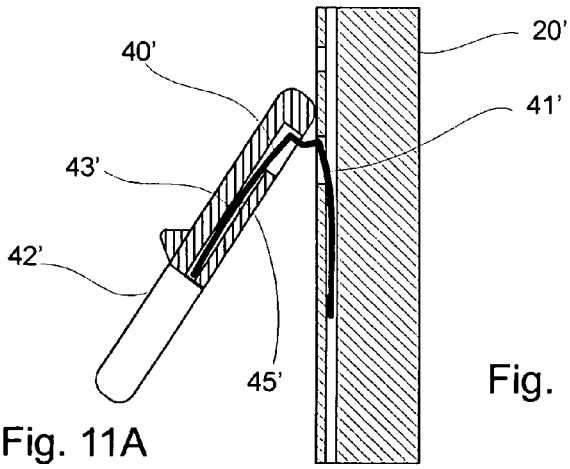
FIG. 11A is a cross-sectional view of another part of a retainer.
Figure 12A:
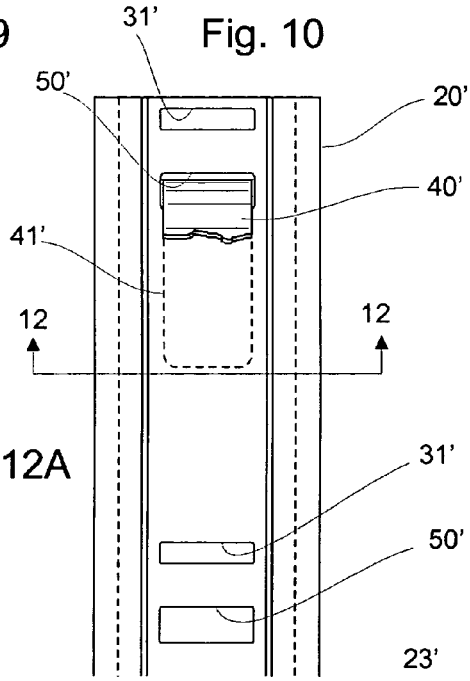
FIG. 12A is a partial front view of a front side of a base with a biasing member inserted therein.
Figure 12C:
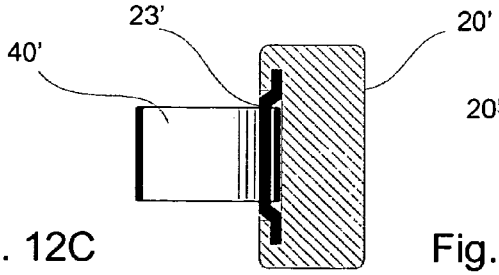
FIG. 12C is a cross-sectional view through line 12—12 in FIG. 10 with a biasing member inserted.
Figure 12B:
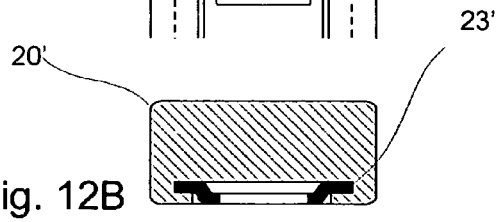
FIG. 12B is a cross-sectional view through line 12—12 in FIG. 10 without a biasing member.
Figure 13B:
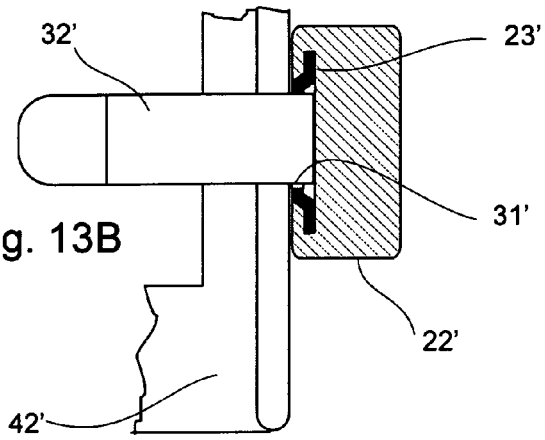
FIG. 13B is a partial top view of the invention taken through line 13A—13A shown in FIG. 13A.
Figure 14B:
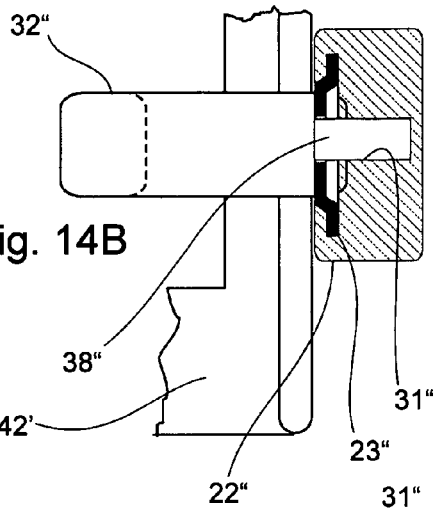
FIG. 14B is a partial top view of the invention taken through line 14A—14A shown in FIG. 14A.
Figure 13A:
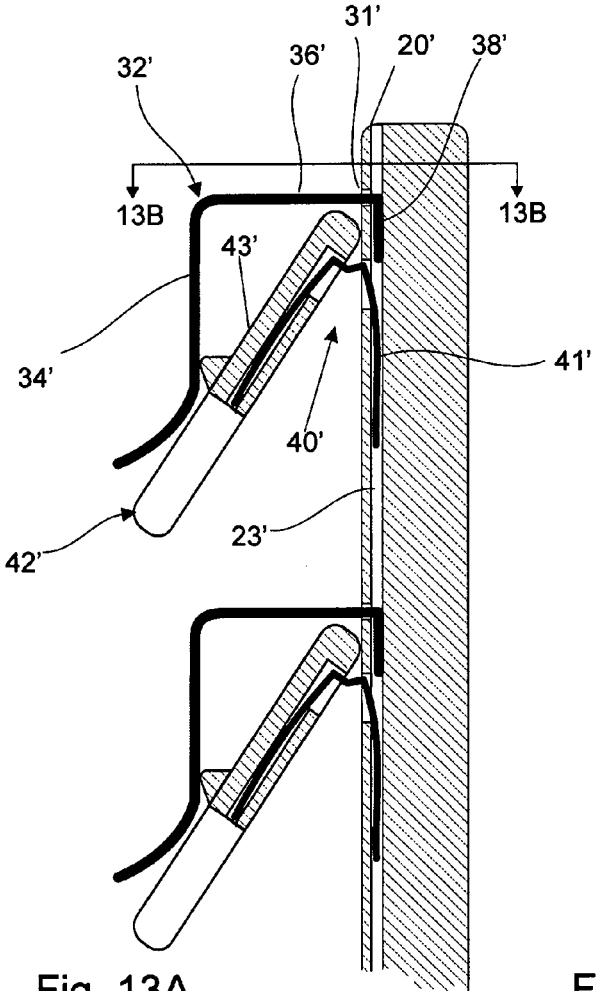
FIG. 13A is a cross-sectional view through part of an embodiment of retainers of the invention.

In FIG. 13A, the retaining member 32' includes a short side 38' which inserts into a longitudinal channel 23' cut into the front side 20' through a groove 31' in the front side 20' to snap and lock the retaining member 32' in place. Longitudinally displaced from and below the groove 23' is another groove 33'. As seen in FIGS. 8 and 13A, a generally U- or V-shaped spring 40' is employed with one side 41' disposed in the channel 23' and another side 43' disposed in a slot 45' of plate 42' through groove 47'. The shape of the springs 40, 40' can vary so long as the intended use with the invention is accomplished.

Figure 14A:
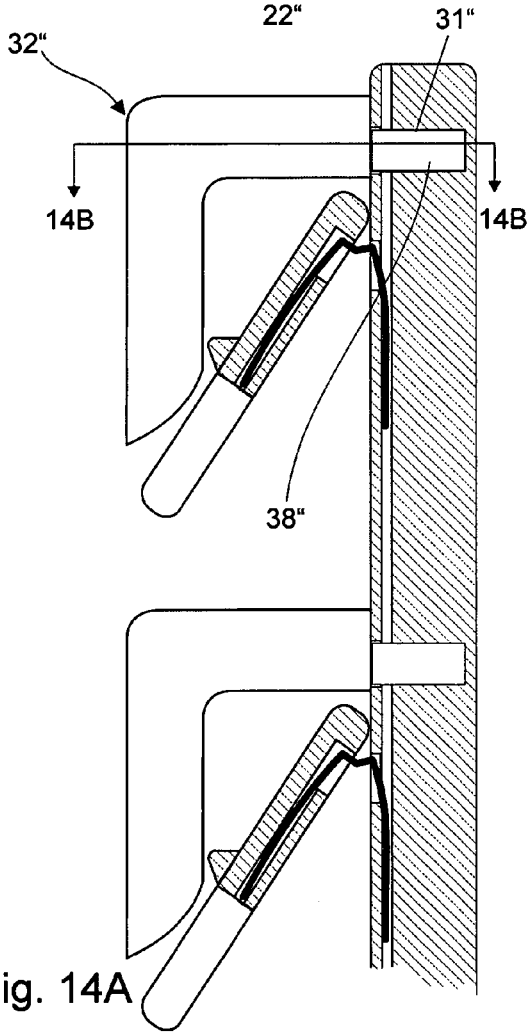
FIG. 14A is a cross-sectional view through part of an embodiment of retainers of the invention.

FIGS. 14A an 14B show another retaining member 32". The member 32" includes a post 38" which can be press fit into a bore 31" of front side 20" and is configured to receive the post 38" in such a manner.

By so providing the above described elements, the instant invention includes means for simultaneously permitting the biasing means to be compressed with part of one's hand, e.g., with one's knuckles, while permitting insertion of a garment, e.g., with one's fingers, between the retaining members with the same hand as seen in FIG. 15. Where upon such insertion, the garment can be supportively retained between and by the retaining members. For removal of the garment, one only need to grasp the desired garment and pull downward to overcome the spring force constant of the biasing element 40. While the present invention has described the hanging of garments, it is understood that the invention can be useful for other articles such as architectural plans or the like for example.

The above described embodiments are set forth by way of example and are not for the purpose of limiting the present invention. It will be readily apparent to those skilled in the art that obvious modifications, derivations and variations can be made to the embodiments without departing from the scope of the invention. Accordingly, the claims appended hereto should be read in their full scope including any such modifications, derivations and variations.

What is claimed is:

1. A hanging device, which includes:

a base having a back side and a front side;

a first retaining member connected to said front side and extending outward therefrom;

a second retaining member disposed adjacent said first retaining member;

first means for biasing said second retaining member toward said first retaining member; and first means extending laterally from said second retaining member in a manner for permitting separate access thereto enabling actuation of said biasing means by application of force applied thereto to displace said retaining members and for permitting said biasing means to be biased with part of one's hand when applying a force against said permitting means causing displacement of said second retaining member from said first retaining member and permitting insertion of an article to be hung between said retaining members with the same hand whereupon at least a portion of the article can be supportively retained between and by said retaining members upon removal of said force from said first permitting means.

2. The hanging device of claim 1, wherein said base is elongated and vertically disposed.

3. The hanging device of claim 1, wherein said first retainer member includes a flared end extending outward from said front side.

4. The hanging device of claim 1, wherein said first retaining member is rigid.

5. The hanging device of claim 1, wherein said second retaining member is rigid.

6. The hanging device of claim 1, wherein at least one of said retaining members includes a ridged surface adjacent a point of contact between said retaining members.

7. The hanging device of claim 1, wherein said front side is disposed at a predetermined angle with respect to the vertical support when said base is mounted thereto such that an upper end of said front side is more outwardly disposed from the support than a lower end of said front side.

8. The hanging device of claim 7, wherein said front side is hingedly connected to said back side.

9. The hanging device of claim 8, which includes a latch for latching said front side to said back side.

10. The hanging device of claim 1, wherein said first biasing means includes an angled-spring metal.

11. The hanging device of claim 1, wherein said device permits removal of the article by pulling on a free end of the article with sufficient force to overcome a spring force constant of said biasing means.

12. The hanging device of claim 1, which includes a third retaining member connected to said front side and extending outward therefrom and longitudinally spaced from said first retaining member, a fourth retaining member disposed adjacent said third retaining member, second means for biasing said fourth retaining member toward said third retaining member, and second means extending laterally from said fourth retaining member in a manner for permitting separate access thereto enabling actuation of said biasing means by application of force applied thereto to displace said retaining members and for permitting said second biasing means to be biased with part of one's hand when applying a force against said permitting means causing displacement of said second retaining member from said first retaining member and permitting insertion of an article between said third and fourth retaining members with the same hand whereupon at least a portion of the article can be supportively retained between and by said retaining members.

13. The hanging device of claim 12, wherein said base is elongated and vertically disposed.

14. The hanging device of claim 13, wherein said first and second retaining members are horizontally disposed with respect to said third and fourth retaining members.

15. The hanging device of claim 13, wherein said first and second retaining members are horizontally staggered with respect to said third and fourth retaining members.

16. The hanging device of claim 1, wherein said permitting means includes an outwardly disposed portion of said second retaining member which is exposed from said first retaining member in a manner to permit access thereto enabling independent actuation of said biasing means by application of force applied to said portion to displace said retaining members without the need of applying force on said first retaining member.

* * * * *